US009700151B2

(12) United States Patent
Ng

(10) Patent No.: US 9,700,151 B2
(45) Date of Patent: Jul. 11, 2017

(54) METHOD OF USING A MULTIFUNCTION CHILDCARE DEVICE

(71) Applicant: CREATIVE NUANCES LTD., Kowloon (HK)

(72) Inventor: Charis Hui Yee Ng, Kowloon (HK)

(73) Assignee: CREATIVE NUANCES LTD., Kowloon (HK)

( * ) Notice: Subject to any disclaimer, the term of this patent is extended or adjusted under 35 U.S.C. 154(b) by 0 days.

(21) Appl. No.: 14/983,757

(22) Filed: Dec. 30, 2015

(65) Prior Publication Data

US 2016/0106227 A1 Apr. 21, 2016

Related U.S. Application Data

(62) Division of application No. 13/623,530, filed on Sep. 20, 2012, now Pat. No. 9,259,100.

(51) Int. Cl.

| | |
|---|---|
| ***A47D 13/02*** | (2006.01) |
| ***A47D 13/04*** | (2006.01) |
| ***A47D 15/00*** | (2006.01) |

(52) U.S. Cl.

CPC ..... *A47D 13/02* (2013.01); *A47D 13/025* (2013.01); *A47D 13/04* (2013.01); *A47D 13/046* (2013.01); *A47D 15/006* (2013.01)

(58) Field of Classification Search

CPC .... A47D 13/025; A47D 13/02; A47D 13/086; A47D 13/04; A47D 13/046; A47D 15/006; A45F 3/14; A45F 3/02

See application file for complete search history.

(56) References Cited

U.S. PATENT DOCUMENTS

| | | | | |
|---|---|---|---|---|
| 2,411,331 | A * | 11/1946 | Nettleship | A47D 13/025 224/159 |
| 3,841,543 | A * | 10/1974 | Bolton | A61G 1/00 224/158 |
| 4,308,629 | A * | 1/1982 | Freemon | A47D 13/086 119/770 |
| 2008/0121191 | A1* | 5/2008 | Wu | A47D 15/006 119/770 |
| 2008/0283561 | A1* | 11/2008 | Parness | A47D 13/025 224/160 |
| 2010/0187268 | A1* | 7/2010 | Rosen | A47D 13/025 224/158 |

* cited by examiner

*Primary Examiner* — Corey Skurdal
(74) *Attorney, Agent, or Firm* — Sand & Sebolt

(57) ABSTRACT

A childcare device including a base in the shape of a closed loop; a cavity bounded and defined by the closed loop; and wherein the device is adapted to receive a part of a child's body through the cavity; and the base is independently usable as a baby sling, a walking aid or a seat safety strap.

9 Claims, 10 Drawing Sheets

FIG-8
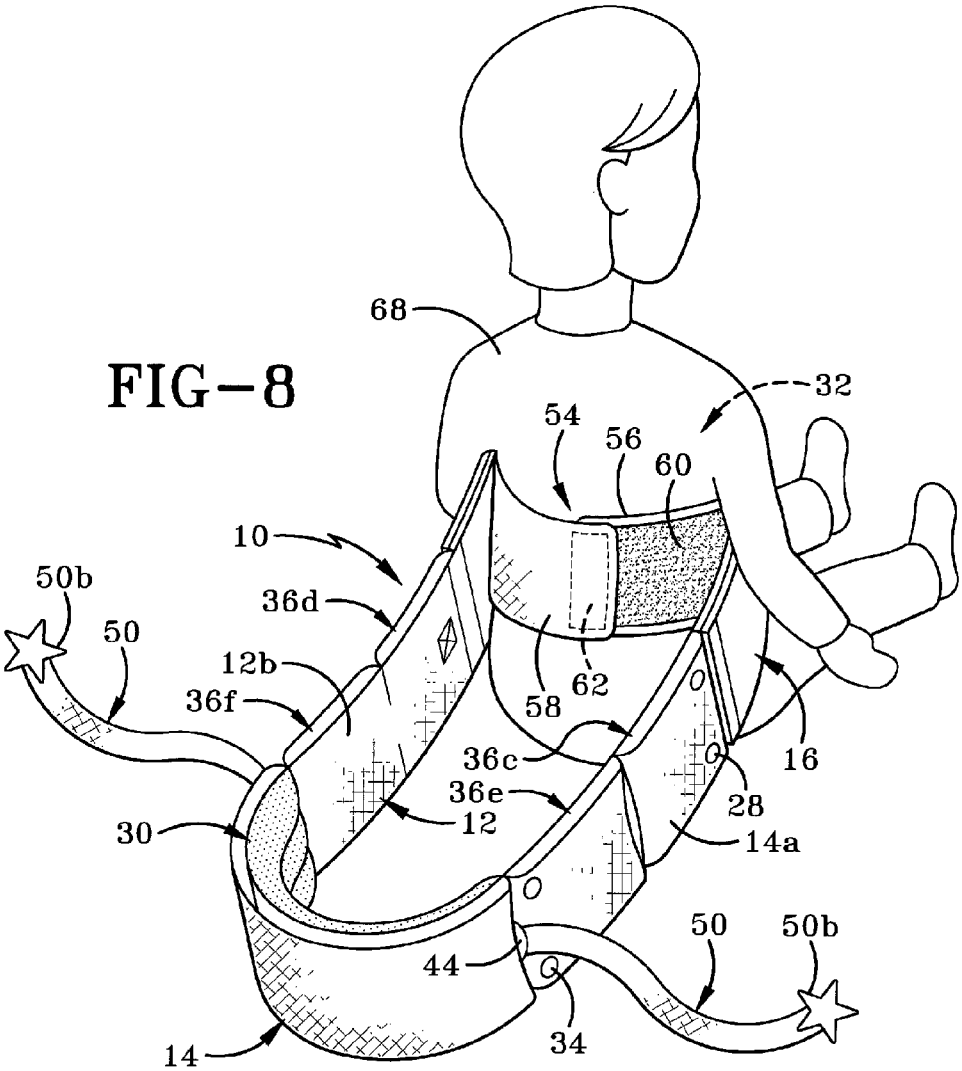
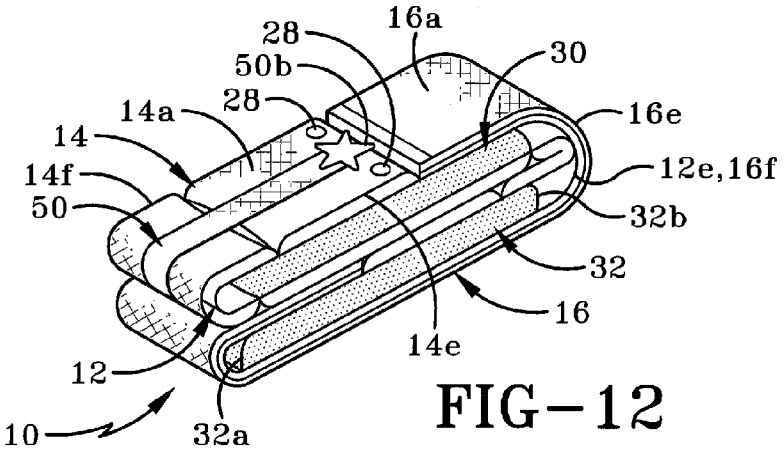
FIG-12

METHOD OF USING A MULTIFUNCTION CHILDCARE DEVICE

CROSS-REFERENCE TO RELATED APPLICATIONS

This is a Divisional of U.S. patent application Ser. No. 13/623,530, filed Sep. 20, 2012, the entire disclosure of which is incorporated herein by reference.

BACKGROUND OF THE INVENTION

Technical Field

This invention relates generally to childcare products. More particularly, this invention relates to devices for carrying or securing babies or young children. Specifically, this invention is directed to a multifunction childcare device that is able to be used as a baby sling to carry infants, a walking aid to support young children learning to stand or walk, and as a seat safety strap to secure young children in a seated position to a chair.

Background Information

Infants need to be held or carried by their caregivers as they are not capable of sitting, standing or walking on their own. Since this holding or carrying can become very tiring, a number of devices have been proposed in the prior art which aid a caregiver to hold or carry a young child. As the child develops and grows, he or she becomes capable of somewhat supporting their own weight in a seated position. At first, the young child will have a tendency to flop sideways, forwards or backwards as they struggle to hold themselves in the seated position. This spontaneous and erratic movement can cause the young child to suddenly fall over when seated. A number of devices have been proposed in the prior art to restrain a young child in a seated position so as to prevent them from accidentally injuring themselves by falling over as they learn to sit on their own.

As the child continues to develop and grow, they gradually learn to stand on their own and finally to walk on their own. As they grow even older and start running around, it becomes desirable for a caregiver to be able to limit the distance a child can run away from them. A number of devices have been proposed in the prior art to help a caregiver to restrain a walking or running toddler.

Some of the devices disclosed in the prior art are capable of performing two of these functions but such devices are typically quite complex in construction and the caregiver needs to go through a number of steps to use the devices for even one purpose. U.S. Pat. No. 5,388,551 to Martusciello discloses a first harness which has a chest-encircling band, shoulder straps which extend upwardly from the chest band, and a tether or pair of handles which are engageable with the shoulder straps. The child is placed in the first harness and the caregiver is able to hold onto the tether or handles to limit the extent to which a walking child may move away from them. A seat region is selectively detachably engaged with the chest band. A second harness comprising shoulder straps and a chest band may be worn by the caregiver and this second harness is securable to the chest band of the first harness so that device may be used as a carrier for a young child.

U.S. Pat. No. 7,886,946 to Gray discloses a baby carrier comprising a shoulder harness which is worn by an adult caregiver and a detachable pouch into which the infant is separately strapped. The caregiver has to lay the infant on a backrest region of the pouch, pull a crotch region between the infant's legs and engage the same to side portions which pass around the waist of the infant. (This operation is substantially similar to the way in which a caregiver would place a diaper on the infant's body.) The pouch is then secured to the shoulder harness worn by the caregiver by engaging mating buckles on the harness and on the backrest of the pouch. When the pouch is engaged with the shoulder harness, the infant is retained in a generally upright sitting position. U.S. Pat. No. 8,028,871, also issued to Gray, discloses that this detachable pouch may, alternatively, be engaged with other secure objects such as parts of a shopping cart or a high chair. In a first instance, the side portions of the detachable pouch are passed around the bars of a shopping cart and are then reengaged with a sliding connection on the front of the pouch. The sliding connection is positioned at the front of the infant's body. In another instance, the shoulder harness normally worn by the caregiver is itself placed around the secure object, such as the back of a chair, and is then secured in the same manner as it would be if buckled together when worn by a caregiver. The pouch is then engaged with the shoulder harness that is secured around the chair back.

U.S. Patent Publication No. 2004/0245298 to Refsum (or related Chinese publication CN1549684) discloses a garment that is worn by a young child and is buckled around their waist and includes shoulder straps which buckle to a crotch region which passes between the legs of the child. A harness is detachably engaged with the garment. The caregiver is able to hold onto the harness to limit the extent to which the child may move away from the caregiver.

U.S. Patent Publication No. 2008/0121191 to Tianyun Wu (or related Chinese Utility Model CN201088344) discloses a device that is able to be used to hold and support young children as they are learning to walk. The device is also able to be used to secure the young child to a chair to aid them in learning to sit up independently. The device includes an elongate, generally rectangular member with a number of harness straps secured generally in the middle of the rectangular member. The harness includes a pair of shoulder straps which extend upwardly from the rectangular member and include buckles which may be used to adjust the length of the same. A region of the rectangular member which extends between the shoulder straps is positioned adjacent the young child's chest. The device also includes a waistband which extends outwardly from the rectangular member and includes a buckle for securement and adjustment of the length of the waistband. Body straps also extend from the shoulder straps and are secured by buckles around the back of the infant. The portions of the rectangular member which extend beyond the body straps form wings which are able to be held by the caregiver to hold and support the young child when walking. The wings are able to be held one in each hand and may additionally each be provided with handles for easier holding onto the same. The wings, body straps and waistband may also be tied or otherwise secured around the back of a chair to support a young child sitting against the back of the chair.

U.S. Patent Publication No. 2010/0282808 to Debnam et al discloses a harness that is worn over at least one shoulder of a caregiver. The harness includes at least one handle which can be grasped by the caregiver to more easily cradle a young child in the arm holding onto the handle. Alternatively, when the child is older, they may themselves hold onto a handle on the harness while being cradled by the caregiver.

Chinese Utility Model CN2120596 to Kuofa Cao discloses a belt which is able to be used to hold an infant on the parent's back, carry the infant, or help the infant learn to walk. In all three instances, the bearing belts of the device are passed around the infant's torso so that they are seated under the infant's arms.

Chinese Utility Model CN2279118 to Zheng Rongmei discloses a device for limiting the movement of a young child away from a caregiver when walking. The device includes a band which passes around the young child's chest and a strap which is secured at each end to the waistband. The caregiver is able to grip the strap to hold onto the child while walking. The publication discloses that the device can also be used to secure the child on a motorcycle.

Chinese Utility Model CN2285598 to Gao Weiwei discloses a device for a caregiver to hold onto a young child when walking. The device includes a band which passes around the child's chest, a pair of shoulder straps secured to the band, and a tether strap which is secured at each end to the chest band and which is able to be held by the caregiver in order to hold on to the child.

While each of the devices disclosed in the prior art function well for the purposes for which they were intended, it becomes necessary for the caregiver to purchase and then carry separate devices which will aid in separate functions regarding carrying an infant or your child, preventing a young child from falling over when seated on a chair, and in order to aid a young child to stand or walk or to limit the extent to which a young child can walk away from the caregiver. As indicated above, some prior art devices can be used for two of these functions but this still requires that the caregiver purchase at least one additional device to perform additional functions.

There is therefore a need in the art for a single device which is able to be adjusted so that it may be used to carry an infant, assist a young child in learning to stand and walk, and to safely and securely restrain a young child in a seated position on a chair.

BRIEF SUMMARY OF THE INVENTION

The present invention is a childcare device that has three functionalities. Firstly, the device may be used as a baby childcare device or sling to transport infants or young children on the caregiver's body. Secondly, the device may be used as a walking aid to assist a young child to stand, learn to walk or for limiting the distance of a walking young child from their caregiver. Finally, the device may be used as a universal seat safety strap.

It is an object of the present invention to provide a device that is convenient for caregivers to use and so that the caregiver will not need to carry a number of one functionality products while traveling with their child.

It is a further object of the present invention to provide a product that targets the needs of a baby once the baby starts to sit up by himself or herself until the time they are more independent and are sitting and standing on their own.

It is further object of the present invention to provide a lightweight childcare device that is both strong and comfortable for the child and for the caregiver who wears the childcare device.

It is yet another object of the present invention to provide a lightweight childcare device that is able to be worn on either of the left-hand side and right-hand side of the caregiver's body.

Yet another object of the present invention is to provide a childcare device that is lightweight but is safe for a child that is seated in the device, while providing a hands and/or arms-free use for the caregiver so that they are able to carry on with other tasks while carrying the child in the childcare device.

It is a further object of the present invention to provide a childcare device which allows a child to be securely strapped into a wide variety of chairs or seating areas in safety.

It is another object of the present invention to provide a childcare device that allows a caregiver to safely train a baby to start sitting, standing or walking on their own in a safe manner and which aids in preventing injury to the baby from falling while learning to sit, stand or walk.

It is a further object of the present invention to provide a childcare device which enables the caregiver to provide support to the baby when learning to stand or walk but which enables the caregiver to provide this support from a distance. The device thus tends to aid in avoiding back strain in the caregiver from perpetually bending over to help support the baby's body weight.

It is yet another object of the present invention to provide a childcare device which is useful for three stages of the child's development including standing, pre-walker, and early walker.

These and other objects are attained by a childcare device in accordance with the present invention which is configured to be worn by adult caregivers in order to safely transport a baby in a hands and arms-free manner. The device of the present invention is further a universal safety strap for seats that allows the baby to be secured onto a wide array of chairs and seating areas. Still further, the childcare device of the present invention is able to be transformed into a baby-assisting walking aid that aids the caregiver in training the baby to stand, balance and walk while being safely monitored and guided by the caregiver.

The device of the present invention comprises a base which is a closed-loop in shape. It includes a heavily padded first pad in a first region of the loop that is worn on a caregiver's shoulder and a lightly padded second pad for the seat or chest support in a second region of the loop. A pleated top panel is attached to the seat/chest support edge which is able to be quickly and easily pulled upward and is secured by a series of adjustable elastic loops to metal studs on the closed loop base. The device also includes two safety flaps which overlap each other and are provided with fasteners to secure them together. Three pairs of pockets are provided on the base to enable the caregiver to grip the same. A concealed quick-release buckle is located near each edge of the first pad. An adjustment strap is attached at a first end to about the central region of the each middle pocket and is threaded, in a concealed manner through and underneath the outer fabric layer and extends outwardly through an slit therein. The adjustment straps are threaded through the quick-release buckles rapid adjustment of the size of the cavity defined by the loop.

A method of using the childcare device in accordance with the present invention comprising the steps of: selecting whether to use the childcare device as a baby sling, a walking aid or a seat safety strap; positioning the device so that at least a part of the child's body extends through a cavity in the device; rotating a first safety flap and a second safety flap into overlapping arrangement with each other over the part of the child's body which extends through the cavity; securing the first and second safety flaps together so as to secure the part of the child's body in the device; and using the device as the selected one of the baby sling, the walking aid or the seat safety strap.

When the device is used as a baby sling, the step of positioning the device around the child's body further includes the steps of: seating the child on a first pad of the device such that their legs are disposed generally at right angles to a first edge of the first pad; and then rotating the first and second safety flaps into overlapping arrangement across the child's lap; passing the device over the head of a caregiver such that the caregiver's body is also received through the cavity; resting a second pad of the device on one of the caregiver's shoulders such that a first region of the device passes across the caregiver's chest and a second region of the device passes across the caregiver's back; and adjusting a pair of adjustment straps to cause the child to be seated generally on the caregiver's hip when the caregiver is in a standing position.

The method may further include the steps of: moving a bottom panel on the device from a folded position to an unfolded position; securing the bottom panel in the unfolded position; and seating the child on the first pad such that a portion of the unfolded panel is disposed adjacent the seated child's back.

The step of securing the bottom panel in the unfolded position further includes the step of passing a loop on the bottom panel around a stud extending outwardly from an exterior surface of the device.

When the device is used as a walking aid, the step of positioning the device around the child's body includes the steps of: seating the child on a surface remote from the device; passing the device over the child's head such that the child's body extends through the cavity in the device; positioning a first pad on the device adjacent the child's chest; overlapping the first and second safety flaps with each other behind the child's back; securing the first and second safety flaps together; standing the child on their feet; inserting the caregiver's hands through a set of first pockets adjacent the first and second safety flaps if the child is an early walker; or inserting the caregiver's hands through a set of second pockets adjacent the first pockets if the child is a more advanced walker; or inserting the caregiver's hands through a set of third pockets adjacent the second pockets if the child is a fully advanced walker; grasping a portion of a center panel of the device in each of the caregiver's hands when they are inserted into the respective one of the first, second, and third pockets; and walking behind the child while grasping the portions of the center panel.

When the device is used as a seat safety strap, the step of positioning the device around the child's body includes the steps of: seating the child on a surface remote from the device; passing the device over the child's head such that the child's body is received in the cavity of the device; positioning a first pad on the device adjacent the child's chest; overlapping the first and second safety flaps across the child's back; securing the first and second safety flaps together; seating the child on a chair having a back such that the back of the chair passes through the cavity of the device between the safety flaps and a second pad; positioning the child adjacent the chair back such that the overlapped safety flaps are disposed in abutting contact with the chair back; and adjusting the adjustment straps to reduce the size of the cavity and secure the device around the chair back.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

FIG. 8 is a rear perspective view of the childcare device engaged around the child's torso and with the safety flaps secured together in order to retain the childcare device around the child's body;

FIG. 12 is a perspective view of the childcare device in folded into a storage position.

Similar numbers refer to similar parts throughout the drawings.

DETAILED DESCRIPTION OF THE INVENTION

Figure 1:
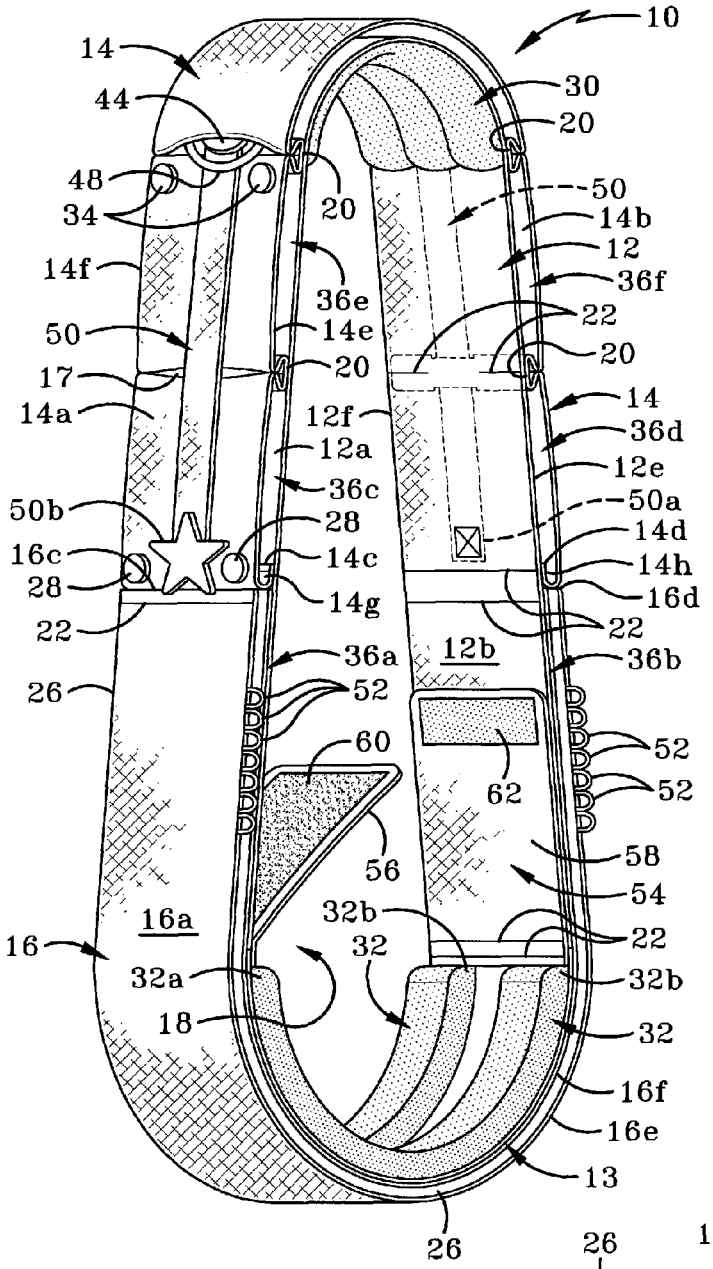
FIG. 1 is a perspective view of a childcare device in accordance with the present invention.

Referring to FIGS. 1-12, there is shown a childcare device in accordance with the present invention, generally indicated at 10. As is evident from FIG. 2, childcare device 10 includes a base which is a closed loop in shape and is comprised of a center panel 12, a top panel 14 and a bottom panel 16. The closed loop formed from center, top and bottom panels 12-16 bounds and defines an interior cavity 18. As will be disclosed later herein, at least a part of a child's body is receivable through this cavity 18 when childcare device 10 is in operation as any one of a baby sling, a walking aid, and a seat safety strap in accordance with the present invention. Childcare device 10 preferably is adjustable so that the dimensions of cavity 18 are able to be changed when childcare device 10 is in use in certain instances, as will be more fully described later herein. In particular, cavity 18 may be made smaller to secure the part of the child's body which extends through cavity 18 or to secure the device 10 to an object, such as a chair. Cavity 18 preferably is returned to its full size when the part of the child's body is to be removed therefrom or when device 10 is to be disengaged from the object to which it was secured.

In accordance with the present invention, the center, top and bottom panels 12, 14, 16 are fixedly secured together at all times to form the closed loop, i.e., center, top and bottom panels 12-16 are fixedly secured together during use as a baby carrier sling, a walking aid and a seat safety strap, as well as when the device is not in use and is folded for storage. This is unlike previously known devices which may be formed into a loop shape during use but then that loop shape is broken when the previously known devices are disengaged from the child or any object to which they have been secured. The advantage this permanently closed loop of the present invention provides over the art is that the presently known device 10 is simpler in construction than previously known devices and is also simpler to use.

Center panel 12 comprises an elongate, generally rectangular length of fabric having an exterior surface 12*a*, an interior surface 12*b*, a first end 12*c*, a second end 12*d*, a first edge 12*e*, and a second edge 12*f*. Center panel 12 has a length (not numbered) as measured between first end 12*c* and second end 12*d*. Center panel 12 also has a width "W1" as measured between first and second edges 12*e*, 12*f*.

Top panel 14 comprises an elongate, generally rectangular length of fabric having an exterior surface 14*a*, an interior surface 14*b*, a first end 14*c*, a second end 14*d*, a first edge 14*e*, and a second edge 14*f*. Top panel 14 is of generally the same width "W1" as center panel 12 where that width is measured between the first and second edges 14*e*, 14*f*. As is evident from FIG. 2, top panel 14 is shorter in length, as measured between first and second edges 14*c*, 14*d*, than the center panel 12. In accordance with a specific feature of the present invention, when the dimensions of cavity 18 are at their greatest, center panel 12 is generally smooth and unfolded along its length. Top panel 14, on the other hand, is provided with one or more permanent pleats 20 therein. Each pleat 20 is formed by creating a series of four spaced-apart folds in top panel 14 so that a generally U-shaped cross-sectional region is formed. Pleats 20 are oriented substantially at right angles to the length of top panel 14. Childcare device 10 preferably includes four spaced apart pleats 20 constructed in this fashion. The inner and outer layers of the top panel 14 which form pleats 20 are stitched together only along first and second edges 14*e*, 14*f*. These stitches (not shown) keep the fabric of top panel 14 in the pleated shape. A slit is defined along the central region of each inner fold of each pleat 20. These slits, can be seen in FIG. 2B and are numbered 15*a*, 15*b*, 15*c*, 15*d*. All of the slits are aligned with each other along the length of top panel 14. The location of slits 15*a*-15*d* is such that the slits themselves are concealed by the outer layers of fabric which form pleat 20.

In accordance with yet another feature of the present invention, top panel 14 is positioned so as to overlay center panel 12 in such a way that interior surface 14*b* of top panel 14 is disposed adjacent exterior surface 14*a* of center panel 12, first edge 14*e* is aligned with first edge 12*e*, and second edge 14*f* is aligned with second edge 14*f*. First end 14*c* of top panel 14 is spaced a distance inwardly away from first end 12*c* of center panel 12; and second end 14*d* of top panel 14 is spaced a distance inwardly away from second end 12*d* of center panel 12. Thus, a section of center panel 12 extends outwardly away from each end of top panel 14. Top panel 14 is secured to center panel 12 by rows of stitches 22 that are positioned centrally between the innermost fold lines of each pleat 20. Generally, the rows of stitches 22 in each pleat are aligned with the gap 17 therein. It will be understood that each pleat 20 may be provided with a single row of stitches 22 or with several rows of stitches 22 that fall one on top of the other or laterally alongside each other without departing from the scope of the present invention. Additionally, the location and orientation of the rows of stitches 20 may be varied without departing from the scope of the present invention. The fabric of center and top panels 12, 14 in the region between the two innermost pleats 22 preferably is not attached together along the first and second edges 12*e*, 14*e*, 12*f*, 14*f* thereof. Thus, a gap is defined between the center and top panels 12, 14 in this region. It will be understood, however, that stitching can be provided along the edges in this region without departing from the scope of the present invention.

Top panel 14 also includes an additional fold line spaced a short distance inwardly from each of the first and second ends 14*c*, 14*d* thereof. Thus, regions 14*g* and 14*h* are disposed in abutting contact with the interior surface 14*b*. Stitches 22 are used to secure these folded regions 14*g*, 14*h* to center panel 12 and thus reinforce this portion of childcare device 10.

Figure 4:
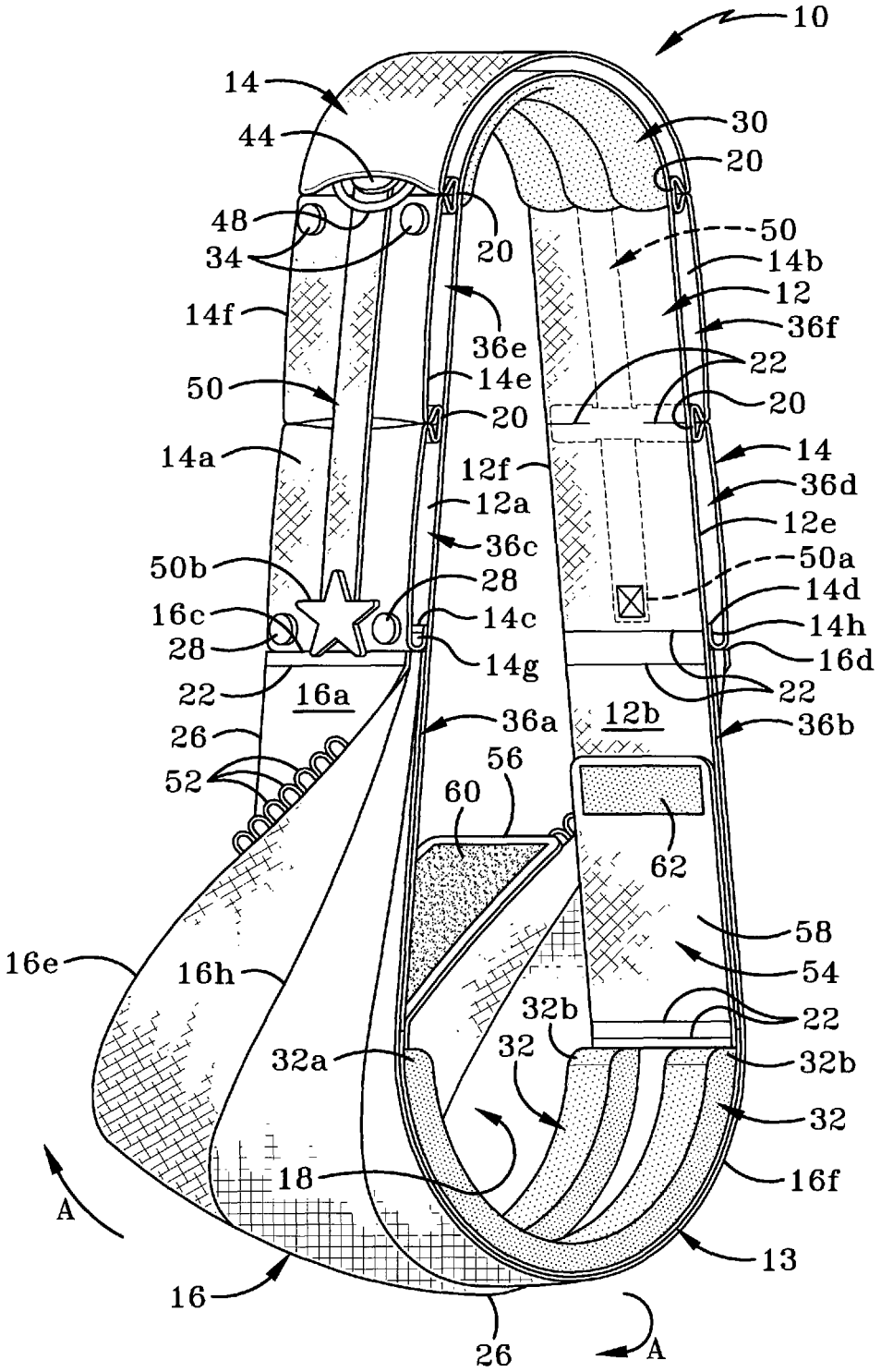
FIG. 4 is a perspective view of the childcare device with the bottom panel being moved from a folded position to an unfolded position.

In accordance with yet another feature of the present invention, bottom panel 16 has an exterior surface 16*a*, an interior surface 16*b*, a first end 16*c*, a second end 16*d*, a first edge 16*e*, and a second edge 16*f*. Bottom panel 16 preferably is comprised of two different fabrics that are connected to each other along a seam 16*h* (FIG. 4). The first fabric is located between first edge 16*e* and seam 16*h*, and the second fabric is located between seam 16*h* and second edge 16*f*. The first fabric utilized in bottom panel 16 is substantially the same as the fabric which is used in center panel 12 and top panel 14. In each of these instances, the first fabric is constructed from two or more layers of material which are sandwiched together and secured by stitching along the outermost edges thereof. Alternatively, these two or more layers of material may be adhesively bonded together or secured together in some other suitable manner. The second fabric preferably is a breathable fabric that allows for dispersal of heat therethrough.

In accordance with a specific feature of the present invention, bottom panel 16 is secured to center panel 12 and top panel 14. Firstly, bottom panel 16 is moved to a folded position and is positioned so that the first section thereof overlays a section of center panel 12 between first end 12*c* and first end 14*c*. First end 16*c* of bottom panel butts up against the fold adjacent first end 14*c*. A second section of bottom panel 16 is positioned to overlay the section of center panel 12 between second end 12*d* and second end 14*d* and the second end 16*d* butts up against the fold adjacent second end 14*d*. Stitches 22 secure the folded first and second ends 16*c*, 16*d* to center panel 12.

Figure 2A:
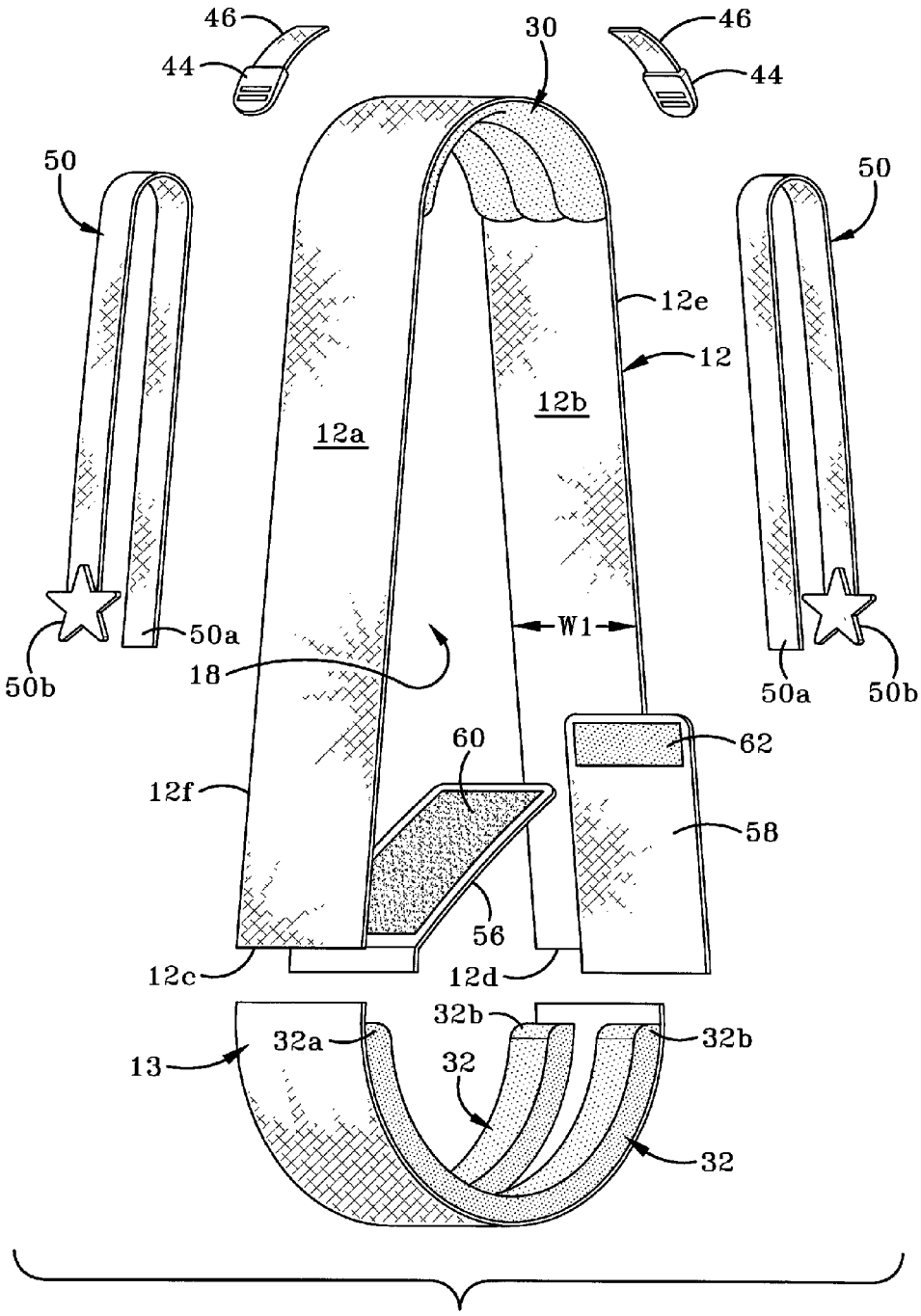
FIG. 2A is an exploded partial perspective view of the childcare device of FIG. 1 showing the center panel, second pad and adjustment straps thereof.
Figure 2B:
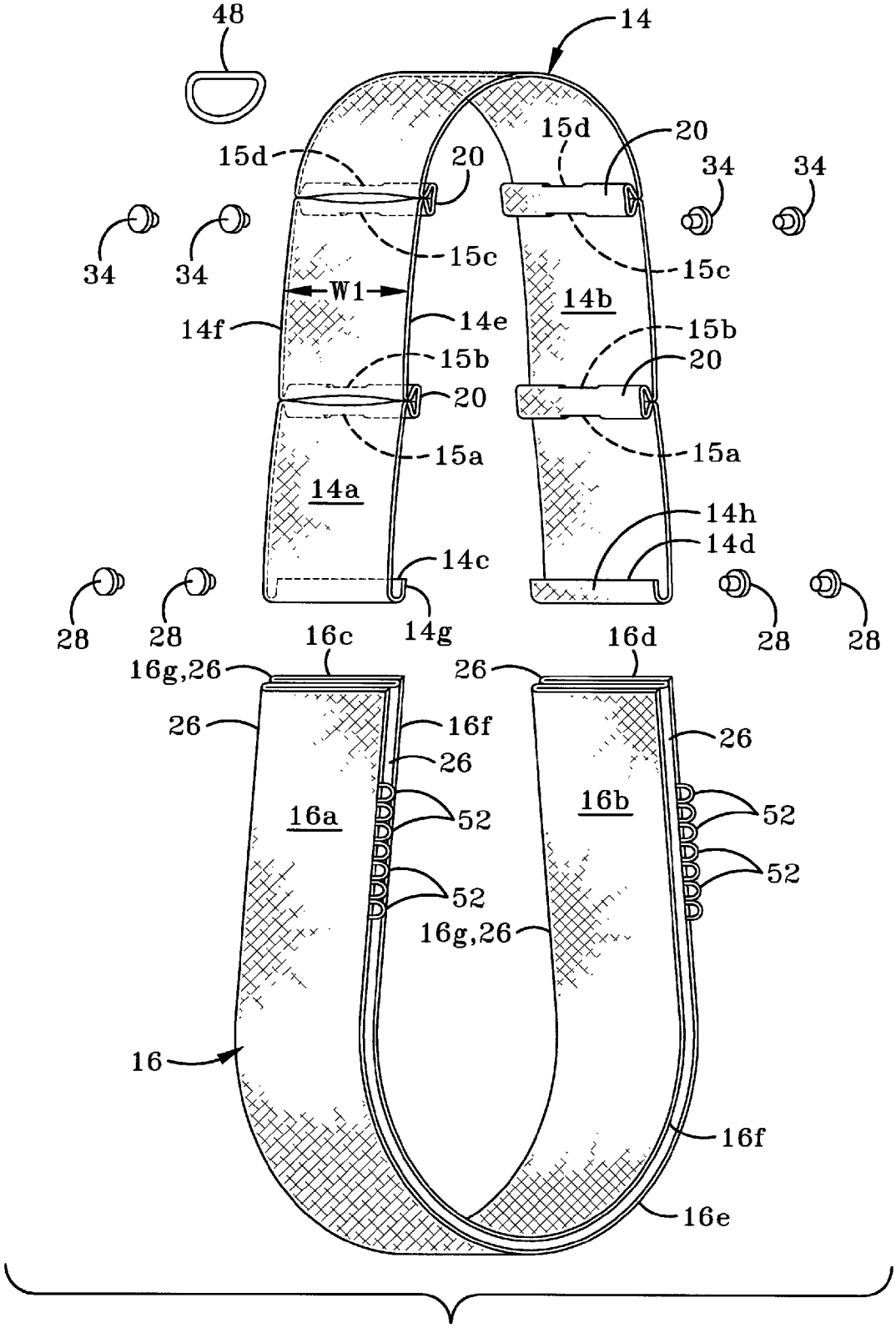
FIG. 2B is an exploded partial perspective view of the childcare device of FIG. 1 showing the top and bottom panels thereof.

Bottom panel 16 has a length measured between the first and second ends 16*c*, 16*d* thereof and a width measured between the first and second edges 16*e*, 16*f* thereof. In accordance with a specific feature of the present invention, the width of bottom panel 16 is greater than the width "W1" of both center panel 12 and top panel 14. Preferably, the width of bottom panel 16 is about four times wider than the width "W1" of either of the center and top panels 12, 14. However, the full width of bottom panel 16 is not always evident. In accordance with a specific feature of the present invention, bottom panel 16 is foldable into a plurality of longitudinally extending folds which extend generally along the entire length of bottom panel 16 between first and second ends 16*c*, 16*d*. Each fold is indicated in FIG. 2B by the reference character 26 and each fold has a width that is substantially equal to width "W1". Bottom panel 16 is able to be moved between a folded position, shown in FIG. 2, and an unfolded position, shown in FIG. 5. In the folded position, folds 26 are disposed one on top of the other and the effective width of bottom panel 16 is generally the same as the width "W1" of each of center and top panels 12, 14. In the unfolded position, folds 26 are opened out so that the width of bottom panel 16 is substantially greater than the width "W1" of each of center and top panels 12, 14. As will be understood, bottom panel 16 may be moved to a partially unfolded position (such as in FIG. 4), where only some of the folds 26 are unfolded, or to a fully unfolded position (such as in FIG. 5), where all of the folds 26 are unfolded and bottom panel 16 is at its greatest possible width. The purpose of this expandability and collapsibility of bottom panel 16 will be discussed at greater length later herein.

A first pair of studs 28 is positioned adjacent each of the first and second edges 14*e*, 14*f* of top panel 14 adjacent regions 14*g*, 14*h*. Studs 28 extend through the fabric of top panel 14 and preferably are manufactured from a strong material such as metal or plastic. One set these studs 28, particularly those located adjacent second edge 14*f* of top panel 14 is used during operation of the device, as will be described later herein. The other set of studs, located adjacent first edge 14*e* is essentially only decorative in nature. Thus, this latter set of studs may be omitted from childcare device 10.

It will be understood that studs 28 may additionally extend through the fabric of center panel 12. Still further, first and second ends 16*c*, 16*d* of bottom panel 16 may be positioned to overlap top panel 14 or to be sandwiched between center and top panels 12, 14. If studs 28 extend through these additional layers of fabric they will secure the various fabric layers together. The layers of fabric, in turn, serve to provide a stronger backing to absorb the forces on studs 28 when they are used to keep bottom panel 16 in the unfolded position, as will be further described herein.

Childcare device 10 further includes a first pad 32 and a second pad 30. First pad 32 comprises a length of fabric 13 to which one or more foam pads. First pad 32, specifically fabric 13, is secured to first and second ends 12*c*, 12*d* of center panel 12. The interior surfaces of first pad 32 and center panel 12 bound and define cavity 18 of childcare device 10. Preferably, the foam pad of first pad 32 is comprised of two lengths of padding that are separated from each other by a longitudinally extending gap. This causes first pad 32 to be more breathable. It will be understood, however, that the foam pad may be a single pad which extends across substantially the entire width of fabric 13. First pad 32 preferably is also fixedly secured to a generally central region of bottom panel 16. Preferably, first pad 32 extends across substantially the width of only that region of bottom panel 16 between second edge 16*f* and first fold line 16*g* (FIG. 2B) and first and second edges 12*e*, 12*f* of center panel 12.

Second pad 30 is provided in a generally central region of center panel 12 and is disposed between first and second ends 12*c*, 12*d* thereof. Preferably, second pad 30 is located adjacent interior surface 12*b* and between the two innermost pleats 20 of top panel 14. Second pad 30 may, alternatively, be disposed between exterior surface 12*a* of center panel 12 and interior surface 14*b* of top panel 14, between the two innermost pleats 20. Second pad 30 may comprise two separate pieces of padding which are located proximate first and second edges 12*e*, 12*f* and are separated by a longitudinally extending gap. The gap makes second pad 30 breathable and improves the airflow in that part of device 10. It will be understood, however, that second pad 30 may extend across substantially the entire width "W1" of center panel 12. Second pad 30 is fixedly secured to center panel 12 by a plurality of rows of stitches, by an adhesive or by any other suitable means. It will be understood that second pad 30 may also be fixedly secured by rows of stitches to top panel 14. Second pad 30 preferably is relatively thick in comparison to first pad 32 and is somewhat shorter relative thereto. First and second pads 32, 30 are disposed opposite each other in the looped shape of childcare device 10.

A pair of studs 34 preferably is provided proximate each end of second pad 30. Studs 34 are made from a strong material such as plastic or metal and they extend through the fabric of top panel 14. It will be understood that studs 34 may, alternatively, be positioned to secure second pad 30 to center and top panels 12, 14. Studs 34 are substantially decorative in nature if they only extend through top panel 14 and may be omitted from childcare device 10 in this instance.

In accordance with another feature of the present invention, childcare device 10 includes a plurality of pockets which are each defined between center panel 12 and top panel 14 or between bottom panel 16 and center panel 12. As shown in FIG. 1, childcare device 10 defines a first pocket 36*a*, a second pocket 36*b*, a third pocket 36*c*, and a fourth pocket 36*d*, a fifth pocket 36*e*, and a sixth pocket 36*f*. First and second pockets 36*a*, 36*b* are disposed opposite each other on the loop of childcare device 10 and constitute a first set of pockets. These first pockets 36*a*, 36*b* are defined between exterior surface 12*a* of center panel and interior surface 16*b* of bottom panel 16. Third and fourth pockets 36*c*, 36*d* are disposed opposite each other on the loop of childcare device 10 and constitute a second set of pockets. Fifth and sixth pockets 36*e*, 36*f* are disposed opposite each other on the loop of childcare device 10 and constitute a third set of pockets. Both of the second and third sets of pockets 36*c*-36*f* are defined between exterior surface 12*a* of center panel 12 and interior surface 14*b* of top panel 14. The purpose of the first, second and third sets of pockets will be described later herein. It will be understood that additional or few numbers of pockets may be provided in device 10 without departing from the scope of the present invention.

In accordance with yet another feature of the present invention, two sets of quick-release buckles 44 are provided on childcare device 10. Each buckle 44 is disposed at the end of a strap 46 (FIG. 2A) which extends through one of slits 15*d* (FIG. 2B) define in the fabric of top panel 14 in one of the two innermost pleats 20 on either side of second pad 30. Each strap 46 extends through the associated slit 15*d* into a region between the fabric of top and center panels 14, 12. Strap 46 is fixedly secured in place to top panel 12 so that buckle 44 is disposed adjacent the exterior surface 14*a* of top panel 14 and extends partially out of the gap 17 of the associated pleat 20. Buckle 44 is partially covered by the fabric which forms pleat 20 and is therefore partially concealed but remains accessible to the caregiver who will use childcare device 10. A metal ring 48 is similarly secured to top panel 14 adjacent each buckle 44. Rings 48 are provided for selective securement of personal items thereto.

Childcare device 10 further includes a pair of adjustment straps 50. Each adjustment strap 50 has a first end 50*a* which is threaded through one set of slits 15*a*, 15*b*, 15*c*, and 15*d* and is secured to exterior surface 12*a* of center panel 12. Preferably, each first end 50*a* is fixedly secured by stitching to a region of exterior surface 12*a* of center panel 12, in a location that falls within the associated one of the third and fourth pockets 36*c*, 36*d*. Each adjustment strap 50 is threaded through the associated one of buckles 44 and terminates in a second tab 50*b* which is disposed adjacent the exterior surface 14*a* of top panel 14. Buckle 44 permits movement of the associated adjustment strap 50 in a first direction but substantially prevents movement thereof in a second direction unless the buckle 44 is first rotated away from the exterior surface 14*a* of the top panel 14. Second end 50*b* may be provided with a decorative component configured in any shape, but preferably is some aesthetically pleasing configuration, such as the star illustrated herein. If such a configuration is selected, the edges of the same preferably are rounded and finished so as to not present any injury hazard to either the child or the caregiver using childcare device 10.

In accordance with another specific feature of the present invention, a plurality of adjustment loops 52 are provided in two regions of bottom panel 16 opposite each other on the loop of childcare device 10. A first plurality of loops 52 are disposed a spaced distance inwardly from first end 16*c* of bottom panel and a second plurality of loops 52 are disposed a spaced distance inwardly from second end 16*d* of bottom panel 16. Preferably, loops 52 begin around 8 cm away from first and second ends 16*c*, 16*d*. Loops 52 extend outwardly from first edge 16*e* of bottom panel 16 and are disposed on the outermost fold 26 of bottom panel 16 when bottom panel 16 in the folded position. Preferably, loops 52 are elastic in nature. Loops 52 are configured to be selectively engaged, one at a time, with a selected one of the adjacent studs 28 to retain bottom panel 16 in a partially unfolded or fully unfolded position, as will be hereafter described.

In accordance with yet another feature of the present invention, childcare device 10 further includes a safety assembly 54 (FIG. 4). Safety assembly 54 comprises a first safety flap 56, a second safety flap 58, a first fastener member 60 and a second fastener member 62. First fastener member 60 is provided on first safety flap 56 and second fastener member 62 is provided on second safety flap 58. Each of the first and second safety flaps 56, 48 preferably is of the same width "W1" as center panel 12, although this is not essential. First safety flap 56 is secured along one end to interior surface 12*b* of center panel 12 at a position adjacent a first end 32*a* of first pad 32. Second safety flap 58 is secured along one end to interior surface 12*b* of center panel 12 at a position adjacent a second end 32*b* of first pad 32. Each of the first and second safety flaps 56, 58 have side edges which are generally respectively aligned with first and second edges 12*e*, 12*f* of center panel 12. The ends of each of the first and second safety flaps 56, 58 are secured to center panel 12 by stitches 22 in such a manner that flaps 56, 58 are able to rotate relative to interior surface 12*b*. Flaps 56, 58 are each able to rotate between an unfolded position where they are disposed adjacent interior surface 12*b* and a folded position where they are disposed at an angle, generally around ninety degrees, relative to interior surface 12*b*. Safety flaps 56, 58 are further configured so that a free end of one of flaps 56, 58 will overlap a free end of the other of flaps 56, 58 for a distance when flaps 56, 58 are rotated into the folded position.

First and second fastener members 60, 62 are provided on first and second flaps 56, 58 in such locations that when safety flaps 56, 58 are rotated into the folded position; fasteners 60, 62 will engage each other and releasably secure flaps 56, 58 to each other. Fasteners 60, 62 may be any suitable mechanism which will temporarily latch or secure safety flaps 56, 58 together. In particular, as shown in FIG. 1, fasteners 60, 62 preferably are mating sections of hook and loop fasteners. As is evident from FIG. 1, fastener 60 on first flap 56 is larger in size than fastener 62 on second flap 58. This enables a measure of adjustability when latching first and second flaps 56, 58 together as the child grows in size. It will be understood that other types of fasteners may alternatively be used to latch safety flaps 56, 58 together; such as mating male and female buckles, oppositely poled magnets, lengths of ribbon, or mating male and female snaps. The purpose of safety assembly 54 will be described later herein.

Figure 3:
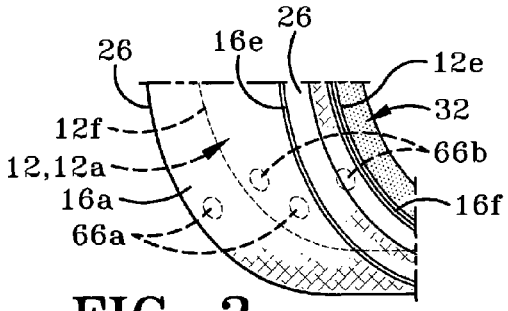
FIG. 3 is a partial perspective view of the bottom panel and second pad showing magnets disposed therein for retaining the bottom panel in a folded position.

Referring to FIG. 3, one or more magnets 66*a* preferably are provided in bottom panel 16 in a position that is complementary to one or more magnets 66*a* in center panel 12 or the bottom of first pad 32. Magnets 66*a* and 66*b* are oppositely poled so that they will attract each other and thereby and secure bottom panel 16 in a folded orientation. Magnets 66*a*, 66*b* thus act as securement devices which ensure that when bottom panel 16 is moved back into the folded position the various folds 26 will align themselves so that bottom panel 16 has an effective width once again that is generally the same as width "W1" of center panel 12. When bottom panel 16 is in this folded position, the childcare device 10 will be able to be quickly and easily neatly folded up for storage, as shown in FIG. 12. Although not illustrated herein it will be understood that other components may be used to aid in keeping the bottom panel in a folded arrangement, particularly when folded for storage. For example, device 10 may be provided with a strap that is secured to bottom panel 16 and wraps there around when folded. This strap could be secured back onto itself by way of hook and loop fasteners located in appropriate positions.

Figure 6:
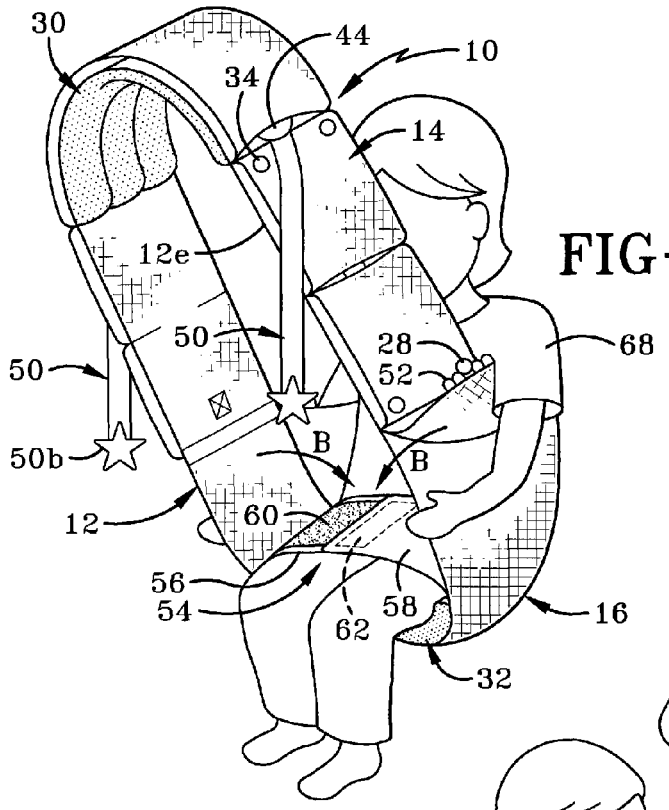
FIG. 6 is a perspective view of the childcare device with a child positioned within the cavity thereof and seated on the second pad, with the safety flaps positioned over the child's lap to secure them to the childcare device.
Figure 7:
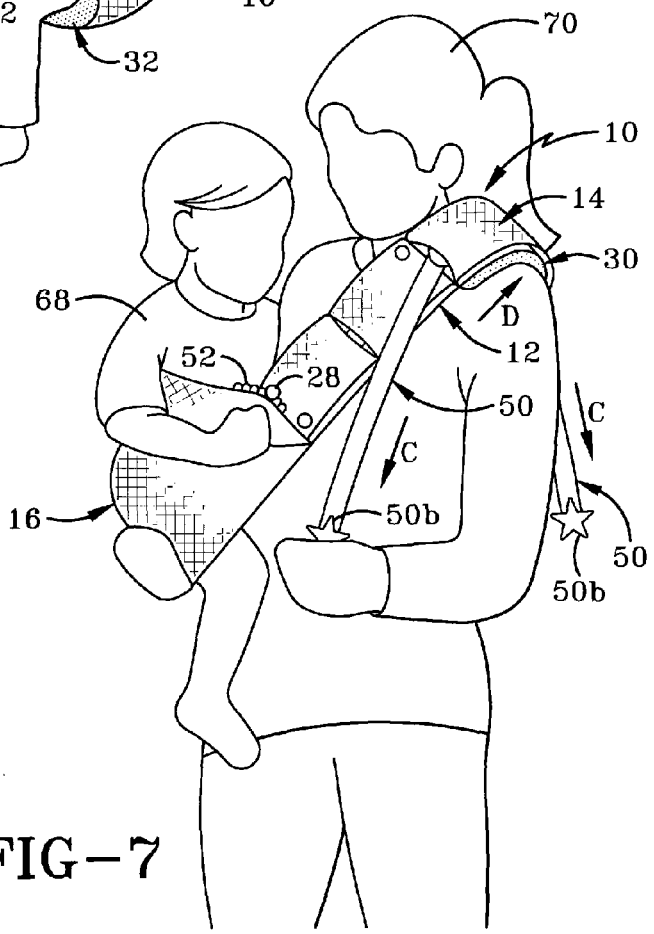
FIG. 7 is a perspective view of the childcare device being used as a baby sling to carry the child, and showing the child secured within the childcare device by the unfolded bottom panel, and the adjustment of the adjustment straps to correctly position the child on the caregiver's hip.
Figure 10:
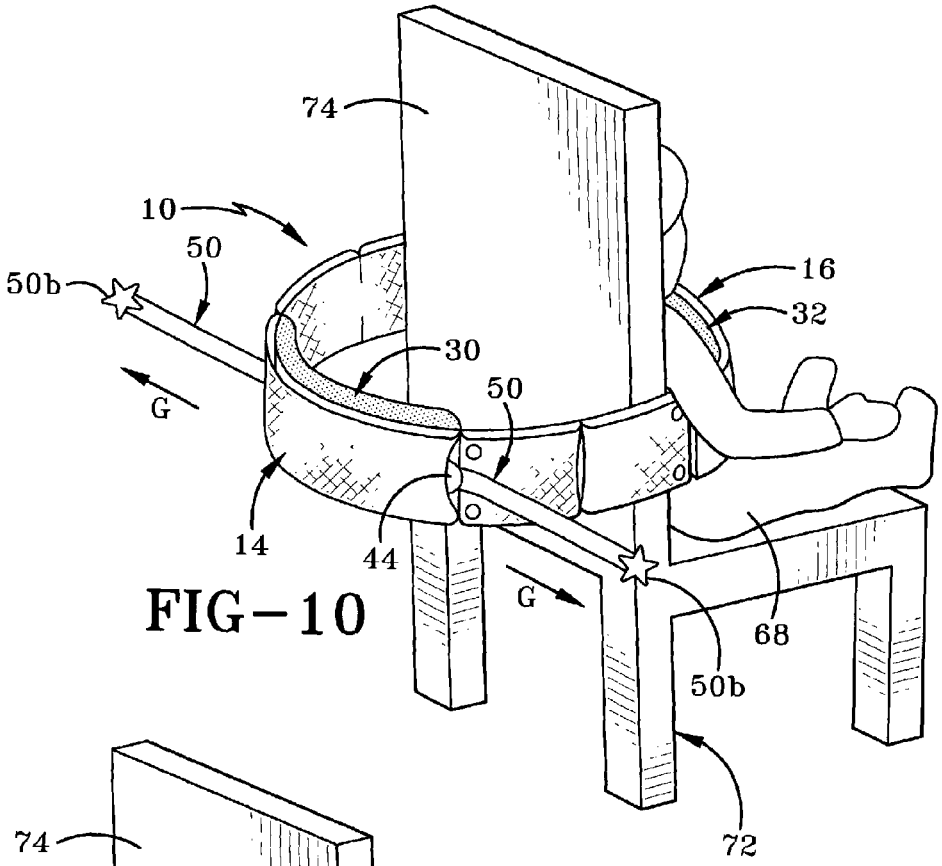
FIG. 10 is a rear perspective view of the childcare device being used as a seat safety strap and being engaged around the body of the child as in FIG. 8, with the child shown seated on a chair, the back of the chair passing through the cavity of the childcare device, and the adjustment straps being adjusted.
Figure 11:
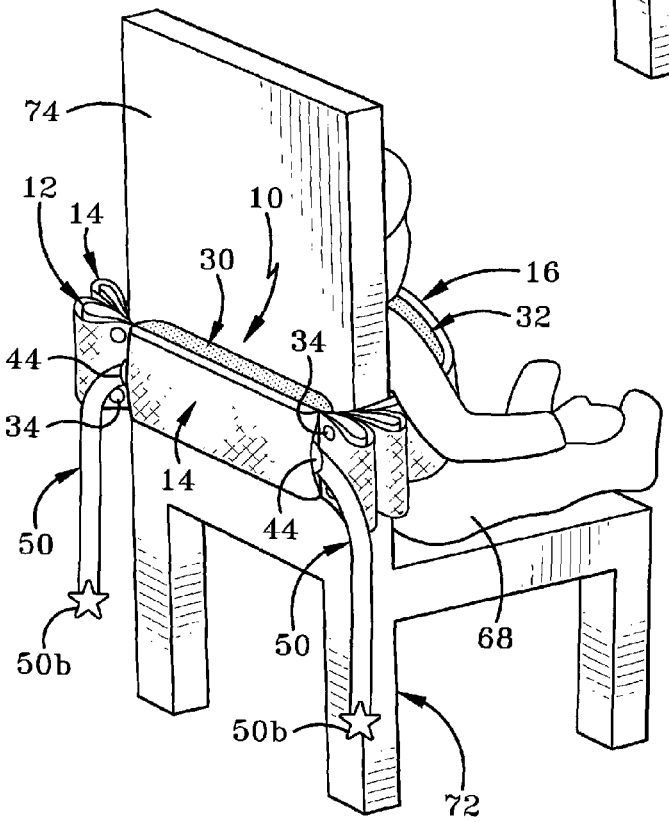
FIG. 11 is a rear perspective view of the child of FIG. 10 with the childcare device secured around the chair back by way of the full adjustment of the adjustment straps.

As indicated previously, the childcare device 10 of the present invention is a multifunction device and preferably is usable three different, distinct, and independent functions. The first function is as a baby sling. This is illustrated in FIGS. 6 and 7. The second function is as a walking aid and is illustrated in FIGS. 8-9C. The third function is as a seat safety strap and is illustrated in FIGS. 8 and 10-11.

Figure 5:
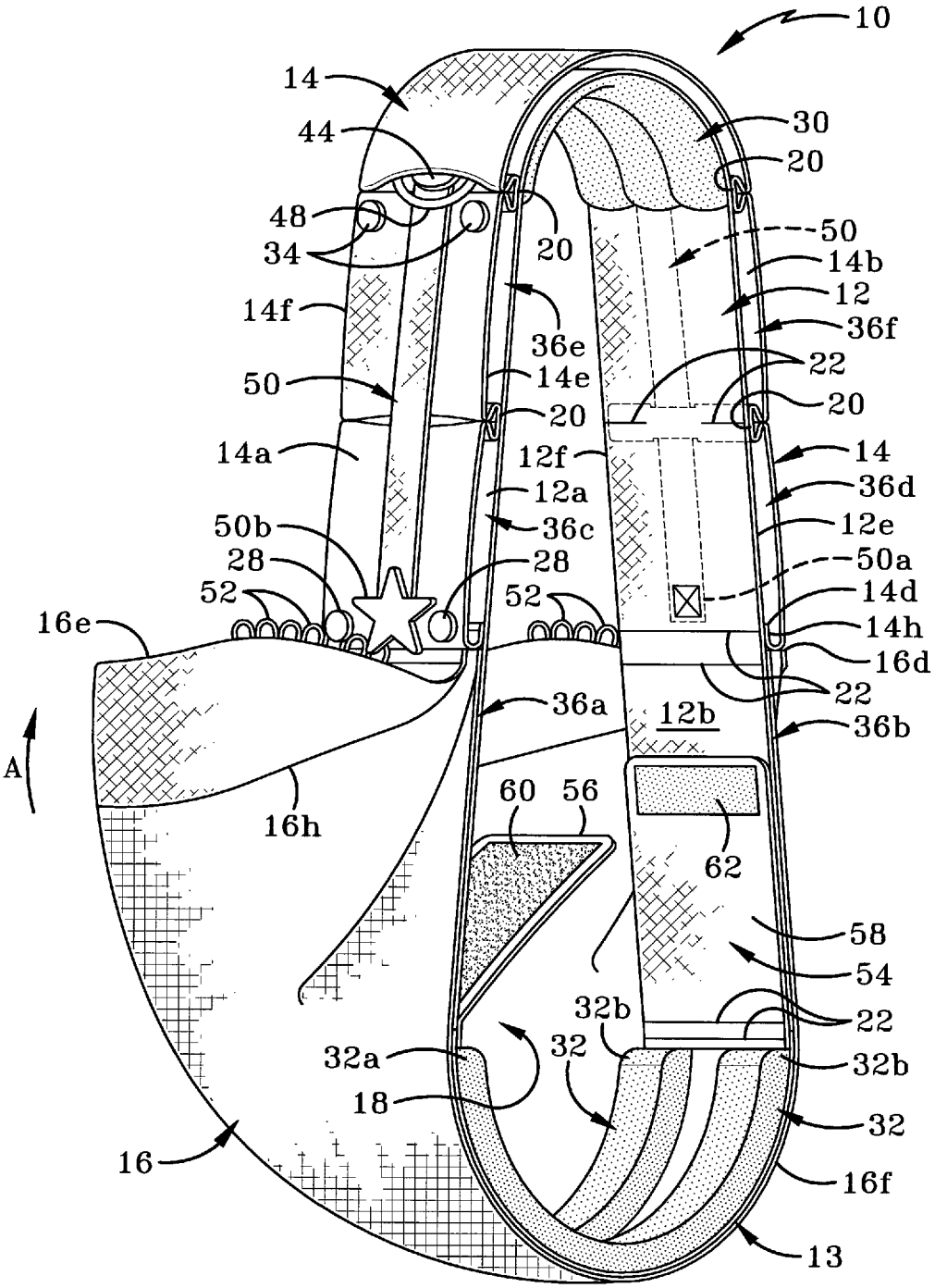
FIG. 5 is a perspective view of the childcare device with the bottom panel in the fully unfolded position and showing the elastic adjustment loops engaged with the studs to retain the bottom panel in the fully unfolded position.

Referring to FIGS. 1-7, the use of childcare device 10 as a baby sling will be further described. Initially, childcare device 10 is in the position illustrated in FIG. 1. In this position, center panel 12 and top panel 14 are at their full, unadjusted length and bottom panel 16 is in a folded or folded position. Additionally, safety flaps 56, 58 are in their unfolded position, leaving cavity 18 and particularly first pad 32, unobstructed. At this point, a child may be seated on first pad 32 such that their legs extend outwardly and generally at right angles relative to second edge 16*f* of bottom panel 16. With younger children, however, bottom panel 16 preferably is first moved from the folded position (FIG. 1) to the unfolded position (FIG. 5) by grasping the first edge 16*e* thereof and moving that first edge in the direction indicated by arrow "A" (FIGS. 4 and 5). This movement causes the fabric of bottom panel 16 to unfold and thereby increases the width of bottom panel 16 from "W1" to more than "W1". When the desired width of bottom panel 16 has been unfolded, the caregiver will slip one of each plurality of adjustment loops 52 over the studs 28 adjacent second edge 14*f* of top panel 14. This engagement of loop 52 on stud 28 is accomplished on both side of childcare device 10. The engagement of loops 52 and studs 28 will substantially prevent bottom panel 16 from folding up and returning to a narrower width. The caregiver will then seat the young child 68 on first pad 32 so that the child's back is positioned adjacent the interior surface 16*b* of bottom panel 16 and the child's legs extend outwardly from childcare device 10, generally at right angles to first pad 32 and will extend toward the caregiver's body 70 when childcare device 10 is worn. Safety flaps 56, 58 are then rotated downwardly in the direction of arrow "B" (FIG. 6) from their open position where they do not overlap, into their closed position where they do overlap. In the closed position, safety flaps 56, 58 extend across the child's lap and secure them into device 10. Fasteners 60, 62 are engaged to latch the overlapping safety flaps 56, 58 to secure the child into childcare device 10. The caregiver 70 then faces the child 68, bends over and slips their head through cavity 18 of childcare device 10, seating second pad 30 on their shoulder. The caregiver 70 will then support the child 68 and childcare device 10 and stand up, so that one portion of childcare device 10 will lie across the caregiver's chest and the other portion thereof will lie across the caregiver's back and child 68 will be seated generally on the caregiver's hip as shown in FIG. 7. Childcare device 10 is oriented so that the unfolded bottom panel 16 is disposed a distance away from the caregiver's body. The child 68 is therefore effectively seated with one their legs extending across the front of the caregiver's body and the other leg extending across part of the back of the caregiver's body. When the child 68 is securely seated in this fashion, the caregiver will be able to adjust childcare device 10 to effectively change the overall length between first and second pads 32, 30 thereby reducing the dimensions of cavity 18. This adjustment will improve the fit of childcare device 10, making it more comfortable for the child 68 and caregiver 70. This adjustment also reduces the amount of strain carrying child 68 will place on the caregiver's back. This length adjustment is effected by pulling downwardly on both of the adjustment straps 50 in the direction of arrow "C" (FIG. 7), with the straps being pulled one at a time. The caregiver is able to reach the adjustment strap 50 behind their back because of the length thereof but it will be understood that someone other than the caregiver 70 may pull downwardly on that adjustment strap 50 to make it easier for the caregiver to make the necessary length adjustments. As adjustment straps 50 are pulled downwardly, a length of strap 50 each is pulled through the associated buckle 44 and as this occurs a portion of center and top panels 12, 14 is at least slightly folded or gathered up and the first pad 32 is moved toward the second pad 30, thereby raising the position of the child 68 on the caregiver's body. Preferably, when the child is in the correct position they will be sitting on the caregiver's hip.

It will be understood that buckle 44 is configured to lock adjustment strap 50 in position so that when adjustment strap 50 is released, it does not automatically return to its original position. If adjustment straps 50 are pulled downwardly in the direction of arrow "C" to too great an extent, the caregiver 70 can simply push upwardly on one or both buckles 44 in the direction of arrow "D" (FIG. 7) and this will release the grip buckle 44 has on strap 50 and allow some of the length of adjustment strap 50 to slide back through buckle 44. This will effectively increase the distance between first and second pads 32, 30 increasing the dimensions of cavity 18, and slightly lowering the child 68 on the caregiver's hip.

It will be understood that the curvature of the unfolded bottom panel 16 is adjusted by engaging a different one of the plurality of loops 52 with studs 28*a*. The curvature thereof will be changed to make the child more comfortable within childcare device 10, make the caregiver more comfortable, and may also be necessary as the child. For a younger child, for example, the caregiver 70 may prefer to have the child 68 retained closer to the caregiver's body and as the child grows they may prefer to give the child more freedom and have them sit further from the caregiver's body.

It will further be understood that as the child grows older and bigger it may no longer be necessary to move bottom panel 16 from the folded to the unfolded position before seating the child in childcare device 10. In this instance, the caregiver will leave childcare device 10 in the position shown in FIG. 1 and will then seat the older child into the childcare device in the same manner as described above, except without the back support provided by the unfolded bottom panel 16.

In order to remove the child from the childcare device 10 which has bottom panel 16 in either of the folded or unfolded position as described above, the steps described above are simply performed in reverse. Childcare device 10 is then folded as shown in FIG. 12 for storage. As indicated previously magnets 66 make it easier to quickly fold bottom panel 16 into alignment with center and top panels 12, 14 and then fold device into the configuration shown in FIG. 12 for storage.

Figure 9B:
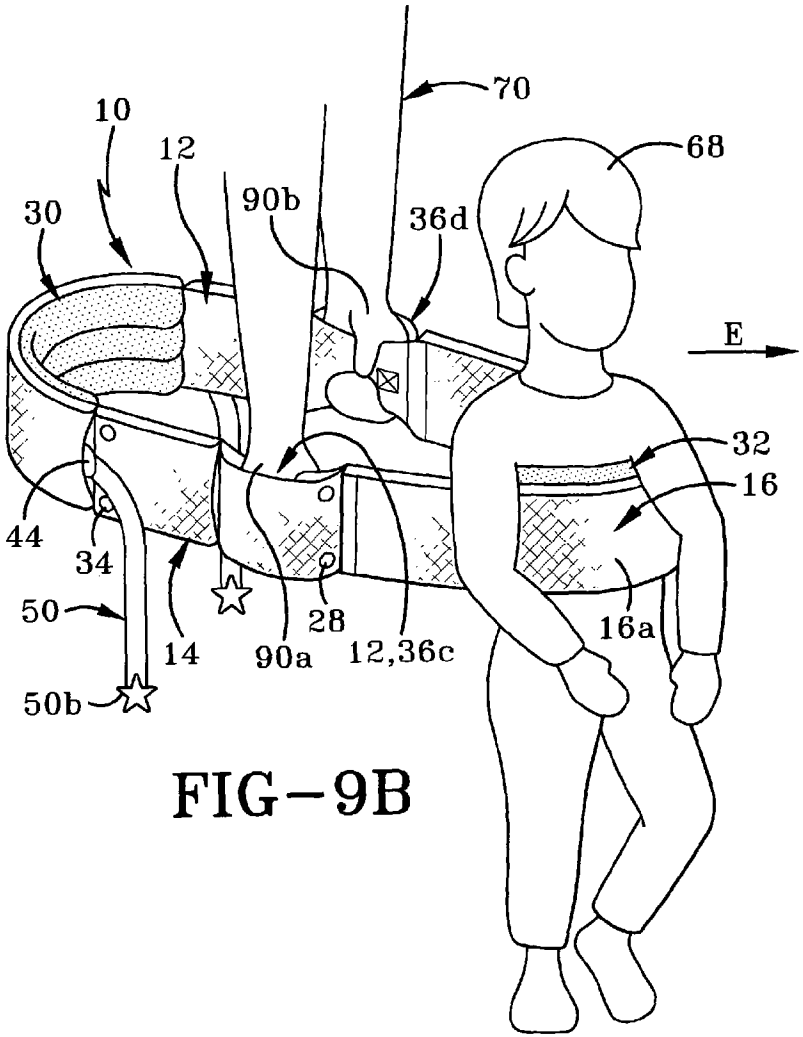
FIG. 9B is a perspective view of the childcare device engaged around the body of a more advanced walker and showing the caregiver's hands engaged in the second set of pockets on the childcare device.
Figure 9A:
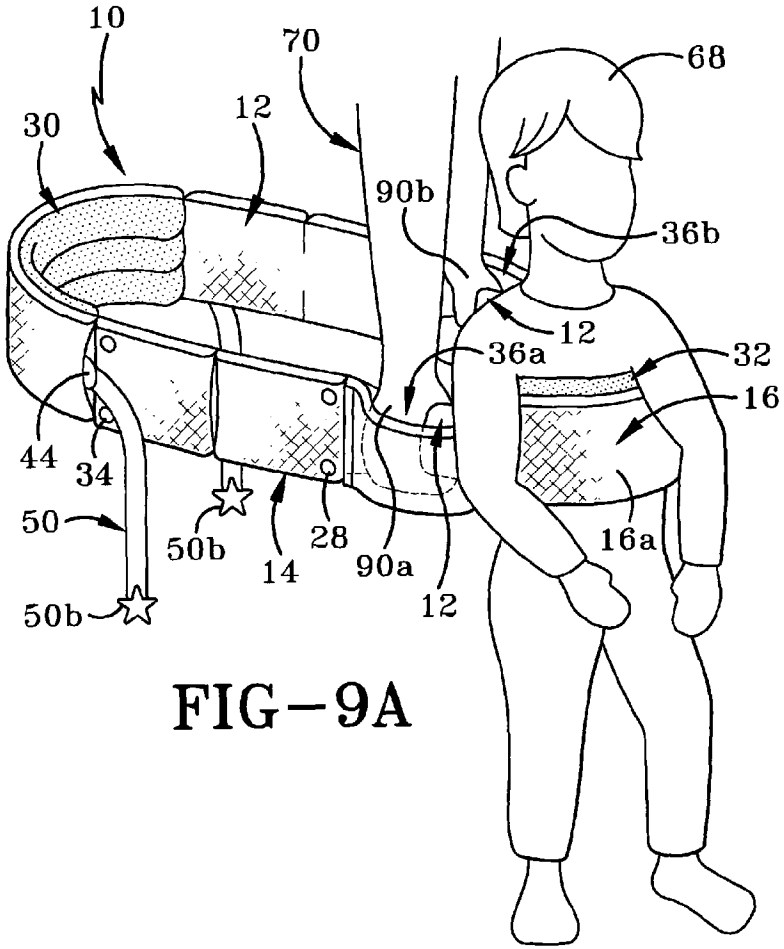
FIG. 9A is a perspective view of the childcare device being used as a walking aid for a child, and showing the childcare device engaged around the child's body in the manner illustrated in FIG. 8, and with the child shown in a standing position and the caregiver's hands engaged in the first set of pockets on the childcare device.
Figure 9C:
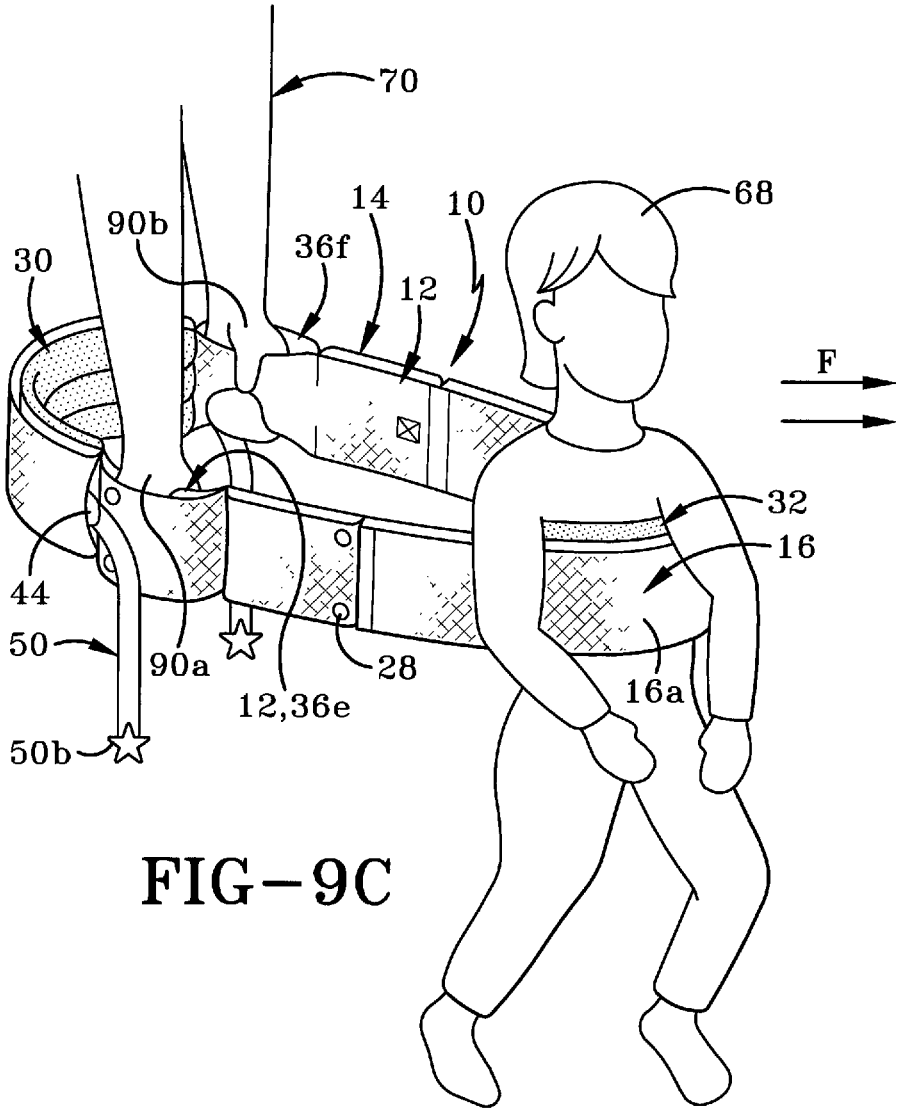
FIG. 9C is a perspective view of the childcare device engaged around the body of an advanced walker and showing the caregiver's hands engaged in the third set of pockets on the childcare device.

Referring now to FIGS. 8-9C, childcare device 10 is illustrated as being used as a walking aid for a young child. Childcare device 10 is readied for this use by ensuring that safety flaps 56, 58 are in an open position, disposed adjacent interior surface 12*b* of center panel 12 so that cavity 18 is substantially unobstructed. Child 68 is seated on a supportive surface and childcare device 10 is passed over their head and around their body so that first pad 32 is disposed adjacent the child's chest, one side of childcare device 10 passes under one arm, and the other side of childcare device 10 passes under the other arm. Safety flaps 56, 58 are rotated in the direction of arrow "B" (as in FIG. 6) away from their contact with the interior surface 12*b* of center panel 12 and are overlapped behind the child's back as shown in FIG. 8. Fasteners 60, 62 are interlockingly engaged together to secure childcare device 10 around the child's torso. Child 68 is then moved into a standing position and the caregiver 70 grasps the part of childcare device 10 that extends rearwardly away from the child's back. In particular, the caregiver will insert their hands through one of the first, second and third sets of pockets 36*a*, 36*b* (FIG. 9A); 36*c*, 36*d* (FIG. 9B); or 36*e*, 36*f* (FIG. 9C) and will grasp the fabric of center panel 12 which contacts their palms. The particular one of the first, second and third pockets selected by caregiver 70 is dependent upon the level of walking skill possessed by child 68. When the child 68 is learning to stand or is an early walker, the caregiver 70 will insert their right hand through pocket 36*a*, and their left hand through pocket 36*b*, as shown in FIG. 9A, and will grab the fabric of center panel 12 that constitutes the surface of childcare device 10 adjacent their palms. Holding onto these fabric sections, the caregiver will have a sufficiently steady enough grip on childcare device 10 that will enable them to aid in supporting the child 68 as they learn to stand and/or walk. Since the child 68 is less able at this point to support their own weight, the caregiver, when holding onto the childcare device at the first sets of pockets 36*a*, 36*b*, is in a better position to help the child support their weight if they begin to fall.

As the child becomes a more competent walker, the caregiver will, instead insert their hands into the second set of pockets 36*c*, 36*d*, as shown in FIG. 9B, and will grasp the fabric of center panel 12 that contacts their palms. The caregiver is then positioned further away from the child 68 and therefore tends to supports the child's body to a lesser degree if they start to fall over.

As the child becomes even more competent a walker, the caregiver will insert their hands through the third set of pockets 36*e*, 36*f*, as shown in FIG. 9C, and grasp the fabric of center panel 12 which contacts their palms. This places an even greater distance between the caregiver and child 68 and lets the child move more freely without needing much support from the caregiver. This is also the position the caregiver can use childcare device 10 if they simply wish to use childcare device 10 as a harness for a competent walker (or runner) to limit the distance the child can travel away from the caregiver.

Obviously, childcare device 10 is easily removed from its engagement around the child's body by disengaging fastener members 60, 62, rotating safety flaps 56, 58 into abutting contact with interior surface 12*b* and then lifting the childcare device loop over the child's head. Once again, childcare device 10 may be folded for storage as shown in FIG. 12.

FIGS. 8, 10 and 11 show childcare device 10 being used for its third purpose, namely, as a seating safety aid useful for securing a young child to a chair 72 having a vertically oriented back 74. Firstly, childcare device 10 is secured around the child in the same manner as for when the childcare device is used as a walking aid (shown in FIG. 8 and described above). The child 68 with the childcare device 10 engaged around their torso, is then seated in chair 72 so that the safety flaps 56, 58 and fastener members 60, 62 are disposed adjacent the front surface of the chair back 74. In this position, the chair back 74 extends through that portion of cavity 18 between safety flaps 56, 58 and second pad 30. The caregiver then pulls the two adjustment straps 50 in the directions indicated by arrows "G" to reduce the size of the cavity 18 within device 10 and thereby tighten childcare device 10 around chair back 74 as shown in FIG. 10. Adjustment straps 50 are pulled until second pad 30 contacts the back surface of chair back 74. Childcare device 10 thus holds the child against the front surface of chair back 74 in an upright fashion. When the caregiver wishes to release the child from this sitting position, he or she will rotate buckles 44 in the direction of arrow "D" shown in FIG. 7. This causes a length of the adjustment straps 50 to move in the opposite direction to arrow "C" and thus increase the size of cavity 18 once again. When cavity 18 is sufficient large enough to enable childcare device 10 to be lifted off chair 72, the child and engaged childcare device 10 are lifted off the seat, the fastener members 60, 62 are disengaged, and safety flaps 56, 58 are rotated back into abutting contact with interior surface 12*b* of center panel 12. Childcare device 10 is then lifted over the child's head and is folded for storage as shown in FIG. 12.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A method of using a childcare device comprising the steps of:

providing a childcare device comprising a base in a shape of a closed loop; wherein an interior surface of the base bounds and defines a cavity; a first pad provided on a portion of the interior surface; a first safety flap secured along one edge to the interior surface adjacent a first end of the first pad; and a second safety flap secured along one edge to the interior surface adjacent a second end of the first pad;

selecting whether to use the childcare device as a baby sling, a walking aid or a seat safety strap;

positioning the childcare device so that at least a part of a child's body extends through the cavity in the device;

rotating the first safety flap and the second safety flap into overlapping arrangement with each other and over the part of a child's body that extends through the cavity;

securing the first and second safety flaps together so as to secure the part of the child's body in the childcare device;

using the childcare device as the selected one of the baby sling, the walking aid or the seat safety strap;

wherein when the childcare device is used as the baby sling and the step of positioning the device around the child's body includes the steps of:

seating the child on the first pad such that the child's legs are disposed generally at right angles to a first edge of the first pad;

rotating the first and second safety flaps into overlapping arrangement across the child's lap; and wherein the method further comprising the steps of:

moving a bottom panel provided on the childcare device from a folded position to an unfolded position;

securing the bottom panel in the unfolded position; and seating the child on the first pad such that a portion of the unfolded bottom panel is disposed adjacent the seated child's back.

2. The method as defined in claim 1, wherein the step of securing the bottom panel in the unfolded position includes passing a loop provided on the bottom panel around a stud extending outwardly from an exterior surface of the base of the childcare device.

3. A method of using a childcare device comprising the steps of:

providing a childcare device comprising a base in a shape of a closed loop; wherein an interior surface of the base bounds and defines a cavity; a first pad provided on a portion of the interior surface; a first safety flap secured along one edge to the interior surface adjacent a first end of the first pad; and a second safety flap secured along one edge to the interior surface adjacent a second end of the first pad; and selecting whether to use the childcare device as a baby sling, or a walking aid or a seat safety strap;

positioning the childcare device so that at least a part of a child's body extends through the cavity in the device;

rotating the first safety flap and the second safety flap into overlapping arrangement with each other and over the part of a child's body that extends through the cavity securing the first and second safety flaps together so as to secure the part of the child's body in the childcare device; and using the childcare device as the selected one of the baby sling, the walking aid or the seat safety strap; and wherein when the childcare device is used as a walking aid the step of positioning the childcare device around a child's body includes the steps of:

seating the child on a surface remote from the childcare device;

passing the childcare device over the child's head such that the child's body extends through the cavity in the childcare device;

positioning the first pad on the childcare device adjacent the child's chest;

overlapping the first and second safety flaps with each other behind the child's back; and securing the first and second safety flaps together.

4. The method as defined in claim 3, further comprising the steps of:

standing the child on their feet;

inserting a caregiver's hands through a set of first pockets provided on the base adjacent the first and second safety flaps if the child is an early walker; or inserting the caregiver's hands through a set of second pockets provided on the base adjacent the set of first pockets if the child is a more advanced walker; or inserting the caregiver's hands through a set of third pockets provided adjacent the second pockets if the child is a fully advanced walker.

5. The method as defined in claim 4, further comprising the steps of:

grasping a portion of a center panel provided on the base of the childcare device in each of the caregiver's hands when the caregiver's hands are inserted into the respective one of the first, second, and third sets of pockets; and walking behind the child while grasping the portions of the center panel.

6. A method of using a childcare device comprising the steps of:

providing a childcare device comprising a base in a shape of a closed loop; wherein an interior surface of the base bounds and defines a cavity; a first pad provided on a portion of the interior surface; a first safety flap secured along one edge to the interior surface adjacent a first end of the first pad; and a second safety flap secured along one edge to the interior surface adjacent a second end of the first pad; and selecting whether to use the childcare device as a baby sling, or a walking aid or a seat safety strap;

positioning the childcare device so that at least a part of a child's body extends through the cavity in the device;

rotating the first safety flap and the second safety flap into overlapping arrangement with each other and over the part of a child's body that extends through the cavity securing the first and second safety flaps together so as to secure the part of the child's body in the childcare device; and using the childcare device as the selected one of the baby sling, the walking aid or the seat safety strap; and wherein when the childcare device is used as a seat safety strap, and the step of positioning the childcare device around a child's body includes the steps of:

seating the child on a surface remote from the childcare device;

passing the childcare device over the child's head such that the child's body is received in the cavity of the childcare device;

positioning the first pad on the childcare device adjacent the child's chest;

overlapping the first and second safety flaps across the child's back;

securing the first and second safety flaps together.

7. The method as defined in claim 6, further comprising the steps of:

seating the child on a chair having a back;

positioning the childcare device such that the back of the chair passes through the cavity of the childcare device and between the secured first and second safety flaps and a second pad provided on the base.

8. The method as defined in claim 7, further comprising the step of:

positioning the child adjacent the chair back such that the overlapped and secured safety flaps are located in abutting contact with the chair back.

9. The method as defined in claim 8, further comprising the step of:

adjusting one or more adjustment straps provided on the base to reduce a size of the cavity and thereby secure the childcare device around the chair back.

* * * * *